US012240564B2

(12) United States Patent
Chirakadze

(10) Patent No.: US 12,240,564 B2
(45) Date of Patent: Mar. 4, 2025

(54) VESSEL SEA CHEST

(71) Applicant: Euro Marine Group Ltd, Ft. Lauderdale, FL (US)

(72) Inventor: George Grigol Chirakadze, Hickory Creek, TX (US)

(73) Assignee: Euro Marine Group Ltd., Ft. Lauderdale, FL (US)

( * ) Notice: Subject to any disclaimer, the term of this patent is extended or adjusted under 35 U.S.C. 154(b) by 422 days.

(21) Appl. No.: 17/726,317

(22) Filed: Apr. 21, 2022

(65) Prior Publication Data

US 2022/0340237 A1 Oct. 27, 2022

Related U.S. Application Data

(60) Provisional application No. 63/177,566, filed on Apr. 21, 2021.

(51) Int. Cl.
*B63B 13/02* (2006.01)
*B63B 13/00* (2006.01)

(52) U.S. Cl.
CPC ..... *B63B 13/02* (2013.01); *B63B 2013/005* (2013.01)

(58) Field of Classification Search
CPC .... B63B 13/00; B63B 13/02; B63B 2013/005
USPC ..... 114/125, 182, 183, 198
See application file for complete search history.

(56) References Cited

U.S. PATENT DOCUMENTS 6,038,993 A * 3/2000 Vento ..... B63B 13/00 43/57
6,766,754 B1 * 7/2004 Scott ..... B63B 13/00 114/74 R

* cited by examiner

*Primary Examiner* — Daniel V Venne
(74) *Attorney, Agent, or Firm* — McHale & Slavin, P.A.

(57) ABSTRACT

A sea chest, discharge tank and black water discharge tank are disclosed, each comprising a chamber preferably formed integral with a vessel hull to eliminate multiple inlets/outlets to the vessel. The discharge tanks employ a removable standpipe to effectively move a thru-hull opening from beneath the vessel water line to a position above the vessel water line. A sea chest includes a chamber for placement of a UV light to treat incoming water.

8 Claims, 8 Drawing Sheets

VESSEL SEA CHEST

PRIORITY CLAIM

In accordance with 37 C.F.R. § 1.76, a claim of priority is included in an Application Data Sheet filed concurrently herewith. Accordingly, the present invention claims priority to U.S. Provisional Patent Application No. 63/177,566, entitled "VESSEL SEA CHEST", filed Apr. 21, 2021. The contents of which the above referenced application is incorporated herein by reference.

FIELD OF THE INVENTION

This invention relates to marine vessels; and more specifically, to the improvement of vessel intake and discharge.

BACKGROUND OF THE INVENTION

A sea chest is commonly known in the industry as an intake chamber from which piping systems draw raw water. As used on a vessel, sea chests are typically protected by removable gratings, and contain baffle plates to dampen the effects of vessel speed or sea state. An enclosure, attached to the inside of the vessel hull provides an underwater chamber shell that is open to the sea. An inlet valve and piping connected to the sea chest allows sea water into a vessel for use in cooling, fighting fire, sanitary purposes, or the like applications.

A sea chest is a watertight compartment, and is typically located in a bilge of a vessel. The sea chest receives sea water by use of a thru-hull assembly, which is an opening in the vessel hull located beneath the waterline and equipped with a valve from which connections are made, sometimes via pumps, wherein sea water is employed to various components such as: water for engine cooling, fire fighting stations, air conditioning systems, raw water rinse downs for anchors and fishing cockpits, heads (toilets) and so forth.

A benefit of a sea chest is that it eliminates the need for numerous thru-hull fittings. Referring to FIG. 1, illustrated is a prior art sea chest that is positioned along an inner wall of a vessel having an intake covered with a strainer grate. From the sea chest is a control valve to control the flow of water directed to a component. A single inlet may provide intake water for various systems mounted in the vessel, limiting the need for a plurality of thru-hulls and associated control valves, each of which must be grounded properly and protected from galvanic corrosion.

Deficiencies in conventional sea chests and discharge boxes include the inability to supply water when the vessel is in dry dock. Still another deficiency is that conventional sea chests require a shutoff by the seacock or the like non-structural valve. Failure of a seacock can result in catastrophic damage to the vessel, such as flooding. Also, an intake grate cannot typically be cleaned or cleared while a vessel is underway due to restrictions of a seacock. Strainers on individual thru-hulls do not stop organic growth or electrolytic action on the thru-hull.

SUMMARY OF THE INVENTION

Disclosed is an improved sea chest and discharge system design. The sea chest is a structural element of the vessel and preferably formed integral thereto, being composed of the same structural material of the vessel hull shell. The intake to the sea chest is via a thru-hull positioned below the waterline of a vessel hull, and an exterior shell strainer is not required. In a preferred embodiment, two sea chests are employed, one mounted on the port side and the second on the starboard side of a vessel hull. A hatch to the sea chest is positioned above the waterline. When the access hatch is removed, the interior design elements of the sea chest are serviceable. The sea chest may include a UV filter and filter elements positioned between the thru-hull intake and a distributions manifold. With the access hatch removed, a structural standpipe is threaded into the thru-hull fitting to raise the elevation of the seawater inlet above the vessel waterline, thereby disabling the supply of seawater to the system. A seawater distribution manifold is connected to both port and starboard sea chests, allowing redundancy for operation and maintenance. The manifold allows the vessel to be operated when it is not floating.

In addition to the sea chest, a discharge and black water discharge tank is disclosed, incorporating the use of a removable standpipe to facilitate maintenance of the boxes, either while floating in water or while placed in dry dock.

An objective of the invention is to improve on the common deficiencies of design, safety, supply, filtration, service, and discharge features of the common sea chest.

Another objective of the invention is to provide a mechanism to allow a supply of water to the vessels machinery while underway with one or both sea chests disabled, but open to receipt of water from onboard freshwater tanks.

Still another objective of the invention is to supply a vessel with water to all systems while the vessel is in dry dock by supplying a single source of water supply to a sea chest.

Yet another objective of the invention is to eliminate the need of requiring individual supply lines to independent vessel systems while in dry dock.

Another objective of the invention is to eliminate the need for non-structural valves or seacocks to shut off the supply of sea water by use of an intake operatively associated with a stand pipe that is temporarily threaded into the sea water intake to raise the level of the intake to above the waterline, thereby preventing seawater from entering the system without a seacock.

Still another objective of the invention is to improve seawater conditioning into a vessel by placement of a UV light and/or filter elements within a sea chest. The UV light prevents the growth of organisms within the system.

Still another objective of the system is to provide an improved discharge box by teaching the use of a standpipe to allow ease of maintenance. In operation, fluid to the discharge box flows in above the waterline, allowing head pressure to displace through the thru-hull. The discharge box has similar design elements as the sea chest, in that the watertight access hatch is above the waterline and the discharge box can be shut off from seawater intrusion via a threaded stand pipe inserted into the thru-hull.

Yet still another advantage of the invention is a completely closed loop seawater system with all intakes and discharges being structural elements of the vessel.

Still another advantage of the invention is a completely watertight hull with zero non-structural thru-hull penetrations.

Another advantage of the instant invention is that the sea chest may be cleaned while underway by closing one of the sea chests by inserting a stand pipe into the thru-hull.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE PREFERRED EMBODIMENT

Figure 1:
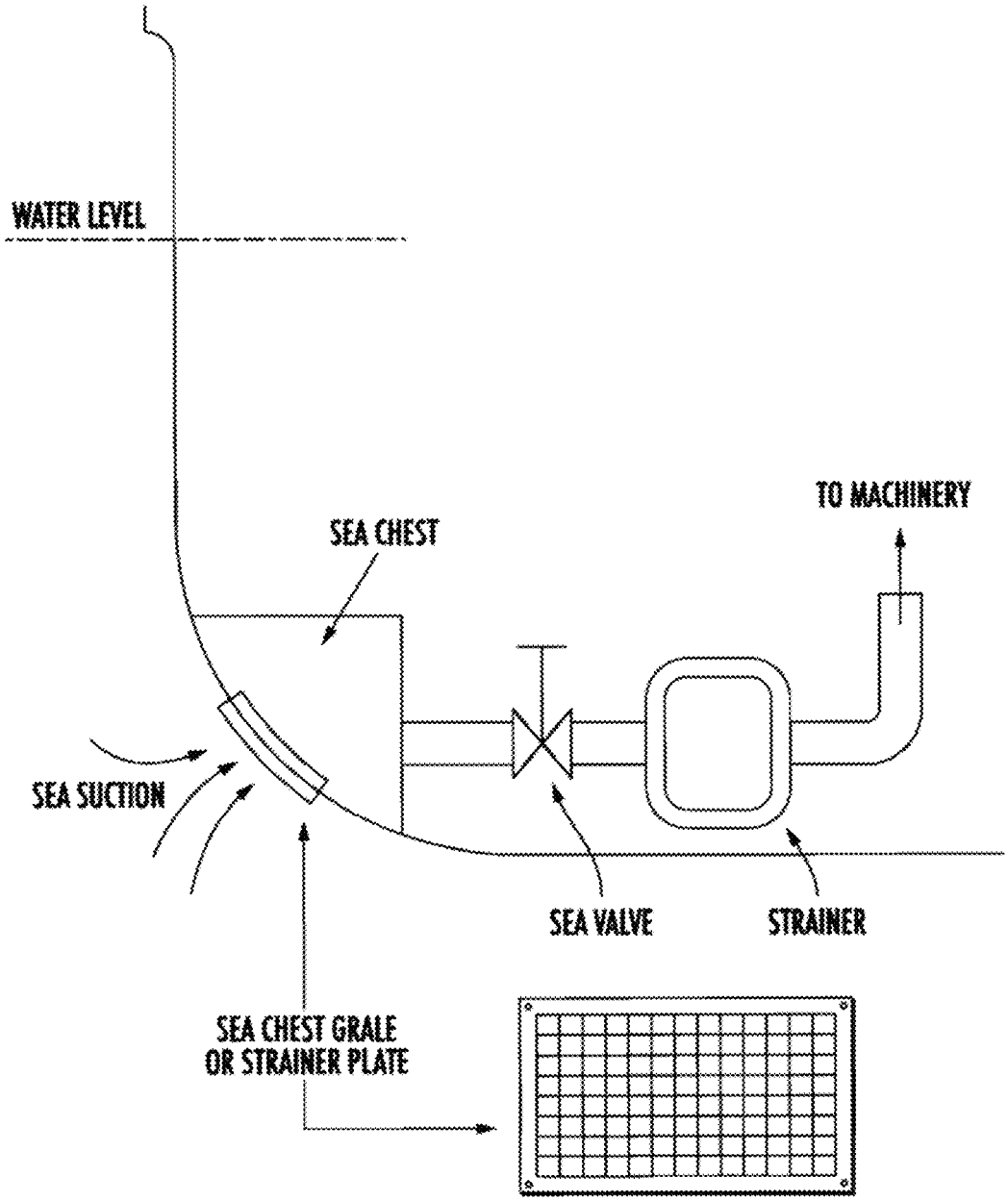
FIG. 1 (PRIOR ART)
FIG. 1 is an illustration of a prior art sea chest.
Figure 2:
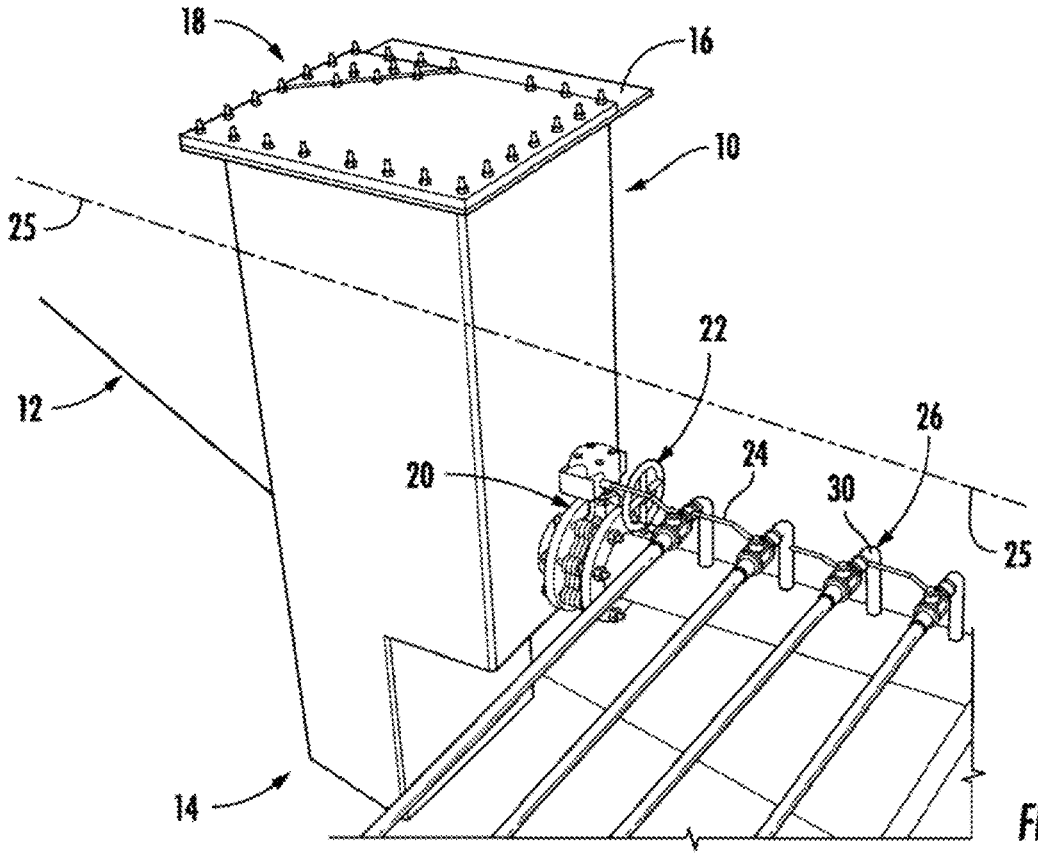
FIG. 2 is a perspective view of a port side sea chest and supply manifold.
Figure 3:
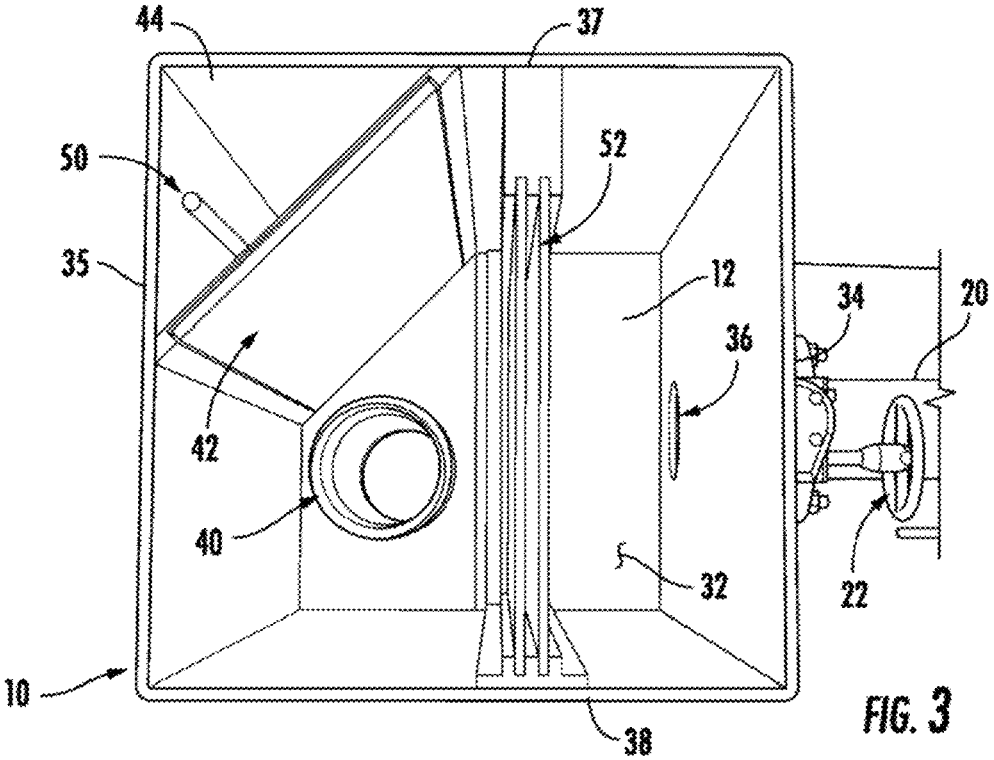
FIG. 3 is a top view of the interior components of the sea chest.

Detailed embodiments of the instant invention are disclosed herein; however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Referring now to FIGS. 2-5, depicted is the sea chest 10 secured to the port side inner surface of a vessel hull shell 12. The sea chest 10 is constructed of the same structural material as the vessel hull 12. The sea chest 10 is constructed and arranged to have a lower end 14 formed integral to the vessel hull 12 and an upper end 16 positioned above the vessel water line 25; the upper end 16 having a watertight hatch 18 for accessing the interior chamber 32 formed by the sea chest 10. A supply manifold 20 is secured to the chamber 32 using a valve 22 for controlling the flow of water out of and into the chamber 32. By way of illustration, the supply manifold 20 provides a conduit feed for individual component attachments 26 each having a manual shutoff valve 30. The amount of component attachments illustrated is for example only; the actual amount of attachments is dependent upon the machinery employed in the vessel.

The interior chamber 32 has a bottom formed from the vessel hull 12, with a first wall 34 having an aperture 36 fluidly coupled to the supply manifold 20 and control valve 22. A second wall 35 is spaced apart from the first wall 34 by opposing side walls 37, 38, which combine to form the interior chamber 32. A threaded seawater intake 40 is positioned in the vessel hull 12, having an intake that extends from the inner surface of the vessel hull 12 and creating an opening on the outer surface of the hull 12. In a preferred embodiment, there is no need for an intake strainer to the seawater intake 40. Within the interior chamber, a UV light may be positioned, preferably in a chamber formed by walls 35 and 37 with a transparent panel 42, such as glass, that provides the passage of UV light into the interior chamber 32. The UV light 50 destroys organic growth within the interior chamber 32. PPR filter elements 52 can be positioned between the seawater intake 40 and the aperture 36. The filter elements 52 are releasably secured to the opposing side walls 37, 38, and prohibit large debris from passing into the aperture 36. It is noted that the filter element 52 and all surfaces of the interior chamber 32 are easily accessible upon removal of the watertight hatch 18.

Figure 4:
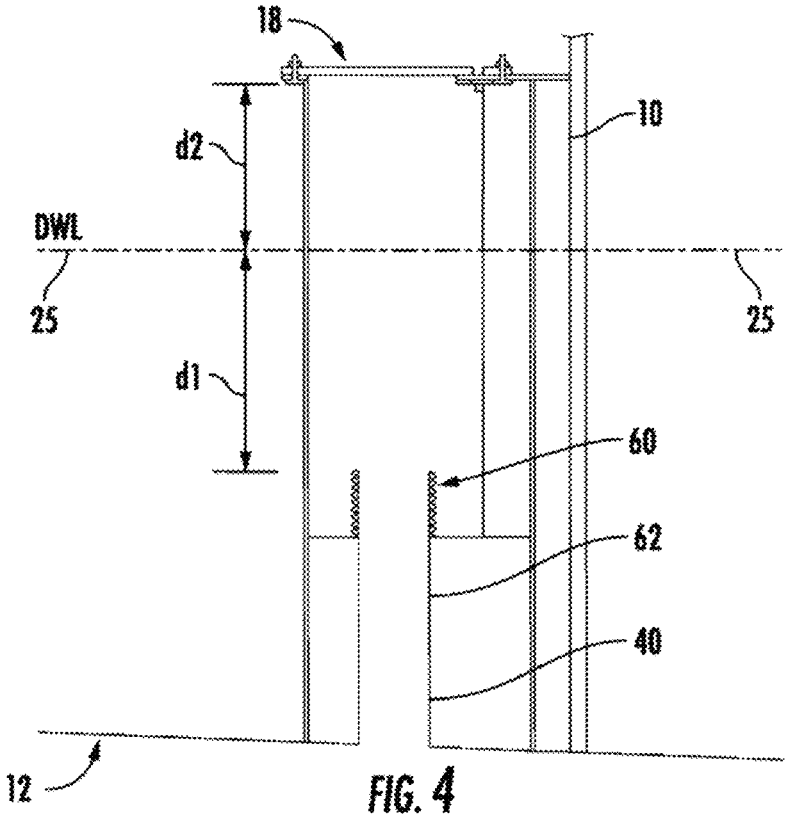
FIG. 4 is a cross sectional side view of the sea chest without a standpipe installed.
Figure 5:
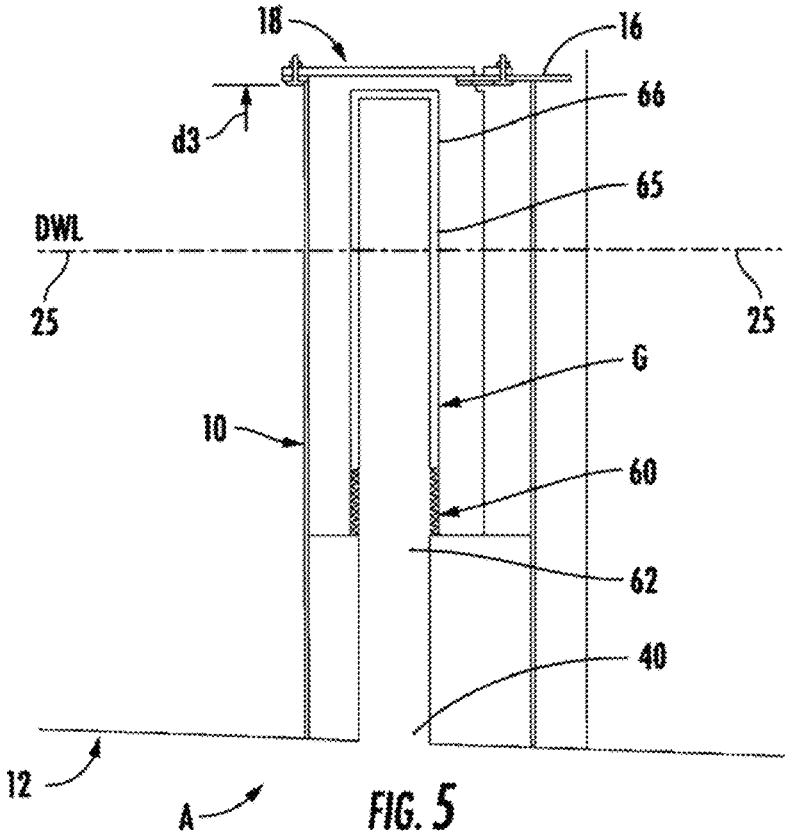
FIG. 5 is a cross sectional side view of the sea chest with a standpipe installed.

The seawater inlet 40 is sized to provide sufficient seawater to various machinery components on board a vessel, such as power plants used for propulsion, generator engine cooling, water makers, air conditioners, yacht stabilizers, cockpit sea water rinse, anchor retrieval sea water rinse, bait tanks and so forth. Referring to FIGS. 4 and 5, depicted is the sea chest 10 having the seawater intake 40 with a threaded male stand pipe fitting 60 forming an upper end 62 to the seawater inlet 40. The stand pipe fitting 60 is positioned a distance $d_1$ below the vessel water line 25; the upper end 16 of the sea chest 10 being located a distance d, above the vessel water line 25, the removable watertight hatch 18 being releasably secured to the upper end 16. The sea chest 10 is preferably constructed of the same structural material as the vessel hull 12. FIG. 5 illustrates a stand pipe 65 threadingly secured to the stand pipe fitting 60. While various methods can be used to attach the stand pipe 65 to the stand pipe fitting 60, the preferred embodiment is for the stand pipe fitting 60 to have male threads constructed and arranged to receive reciprocal female threads formed on the stand pipe 65. Alternatively, the thread pattern can be reversed. The stand pipe 65 preferable has a distance d % between the upper end 16 of the sea chest 10 and the upper end 66 of the stand pipe 65. When the stand pipe 65 is placed in position, water will not flow out of the upper end 66 of stand pipe 65, as it is above the vessel water line 25, effectively shutting off the seawater supply.

Figure 6:
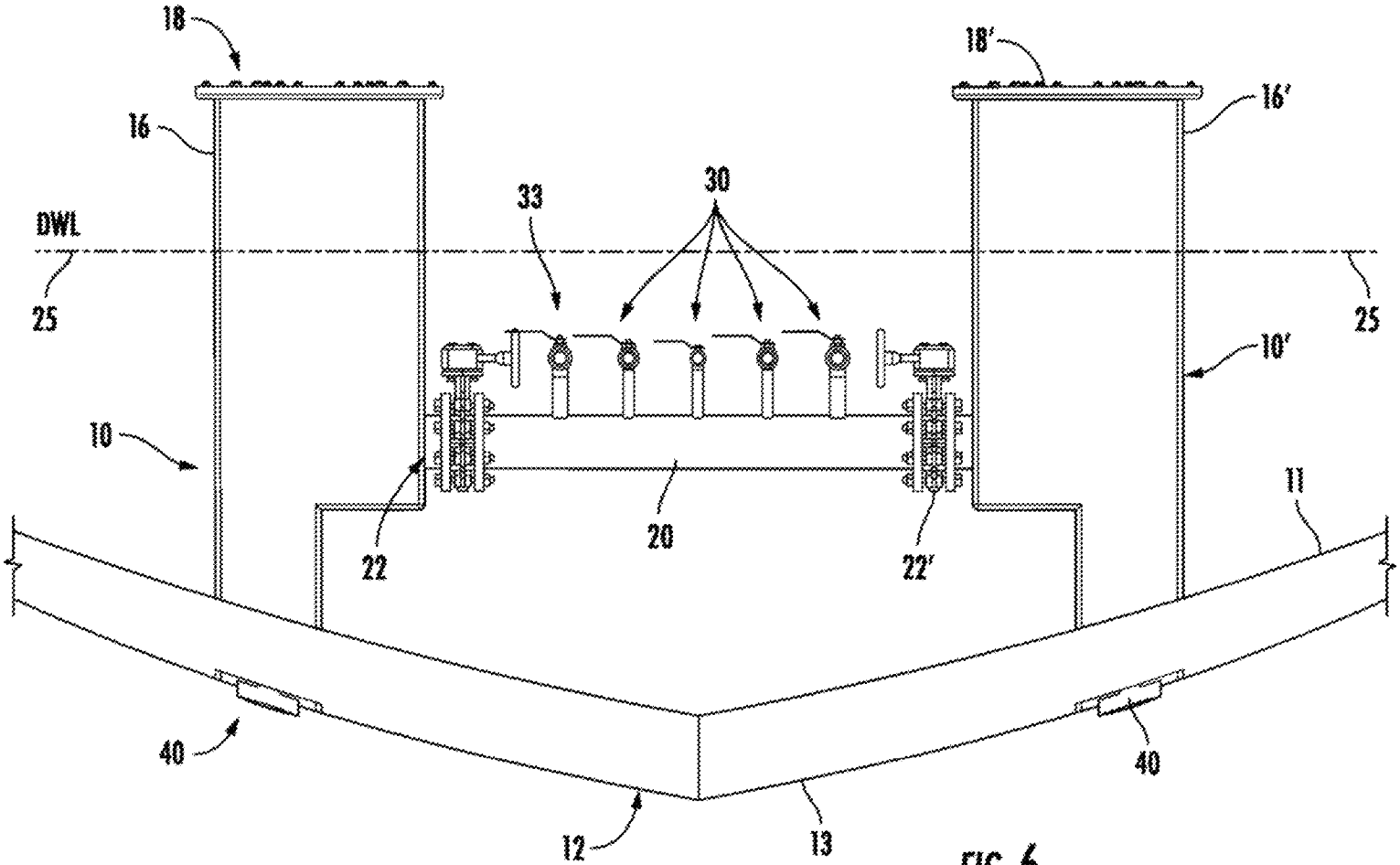
FIG. 6 is a cross sectional side view of a vessel with two sea chests and a supply manifold assembly.
Figure 7:
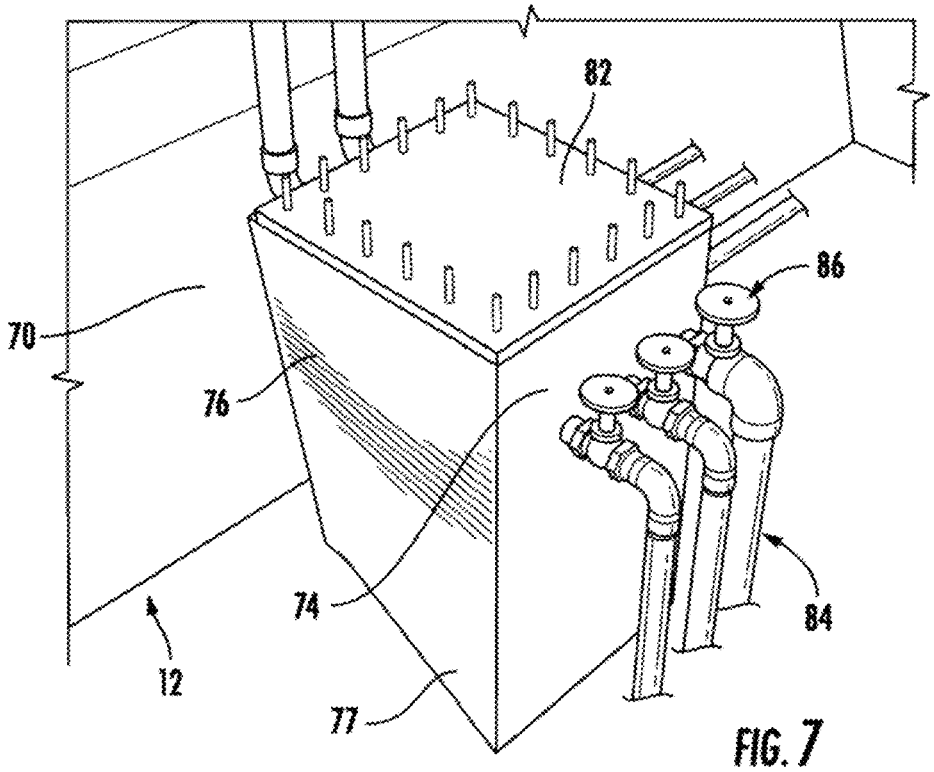
FIG. 7 is a perspective view of a discharge box.
Figure 8:
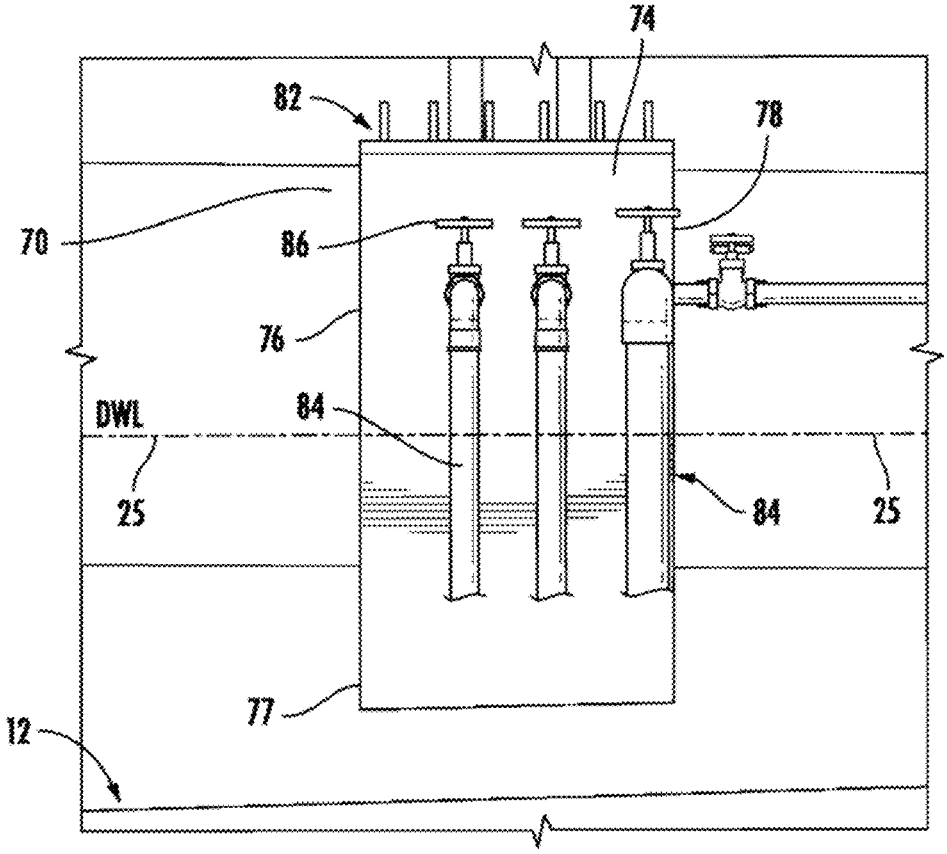
FIG. 8 is a side view of the discharge box.
Figure 9:
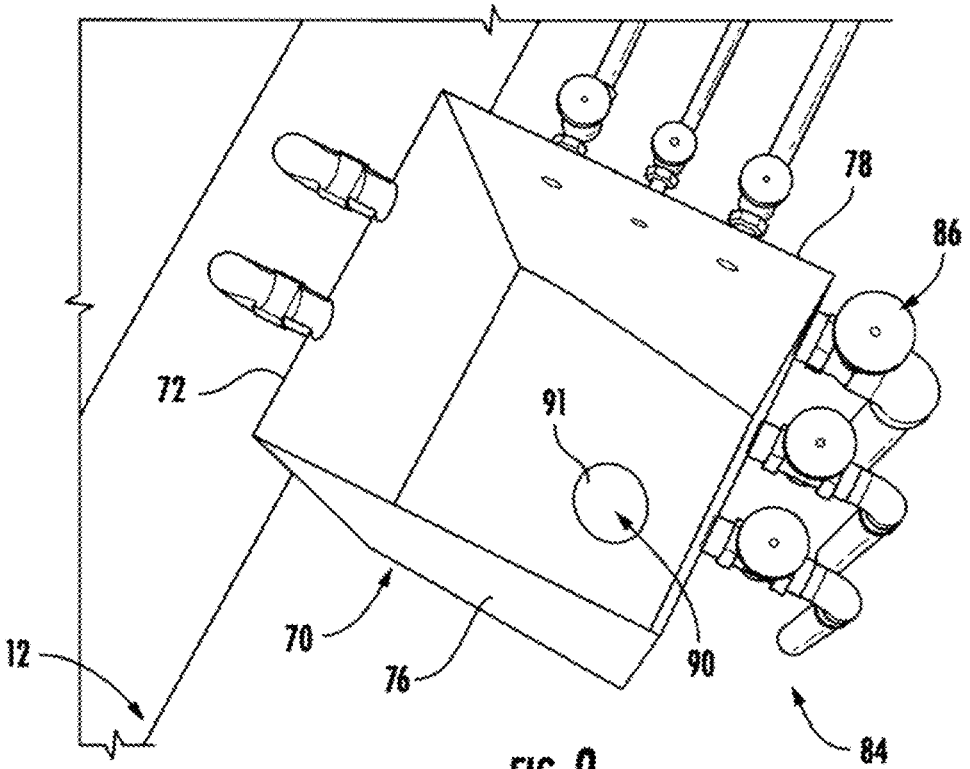
FIG. 9 is a top view of the interior components of the discharge box.
Figure 10:
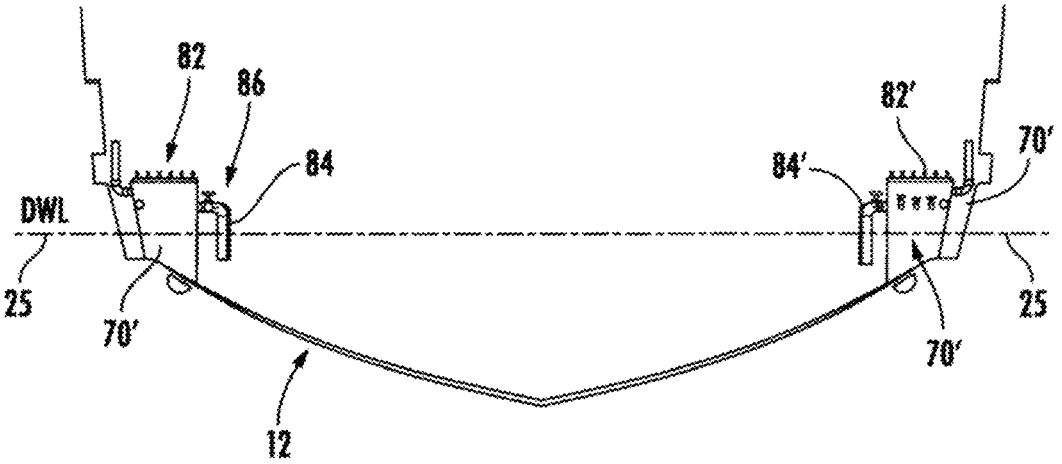
FIG. 10 is a cross sectional side view of a vessel with two discharge boxes.

Referring to FIG. 6, set forth is a first sea chest 10 positioned on the port side of a vessel, and sea chest 10' positioned on the starboard side of the vessel. The sea chests 10, 10' are formed integral with the vessel hull 12, with intake inlets 40 and 40' extending to the outer surface of the vessel hull 12. The sea chests 10 and 10' are preferably constructed of the same structural material as the vessel hull 12. The upper ends 16 and 16' of each sea chest 10, 10' depict the attached hatches 18 and 18' which form a watertight enclosure; removal of which provides access to the interior chamber of the sea chests. The supply manifold 20 is secured to the sea chests 10, 10' with isolating valves 22, 22' for controlling the flow of water into and out of the chambers 10, 10'. By way of illustration, the supply manifold 20 provides a conduit feed for individual components, each having a manual shutoff valve 30.

Either sea chest 10, 10' may be used to supply water to the individual components through the manual shutoff valves 30, or both may be used simultaneously. Control valve 33 is coupled to the vessel fresh water supply, which can be used to supply water to the vessel components through the supply manifold 20 when the sea chests 10, 10' are disabled, such as when the vessel is in dry dock. The fresh water supply may also be used while the vessel is in water, allowing a single point for flushing of saltwater from some or all vessel components. For instance, when a vessel is in a marina, the generator and main engine machinery may be flushed with fresh water, thereby preserving the machinery when not in use.

Referring now to FIGS. 7-10, illustrated is a discharge box 70 formed from side walls 72, 74 and end walls 76, 78. The lower edge 77 of each wall is formed into the vessel hull shell 12. The walls 72, 74, 76, 78 are preferably composed of the same structural material as the hull shell 12, and may be constructed integral thereto. The discharge box 70 has a watertight access hatch 82 positioned above the vessel water line 25 and a plurality of supply lines 84 for receipt of discharged water from the vessel emptied into the discharge box 70. Each supply line 84 has a manually operated shut off valve 86 to isolate the discharge box 70 from the vessel. It is noted that all supply lines 84 enter the discharge box 70 at a position above the vessel waterline 25. A thru-hull outlet 90 extends from an inner surface 11 of the vessel hull 12 to an exterior surface 13 of the hull 12. A portion 91 of the thru-hull outlet 90 is threaded, wherein a standpipe, shown in FIG. 5, can be attached to the threaded thru-hull outlet 90 to raise the outlet above the vessel water line 25, which prohibits water passage. The discharge box 70 allows discharge of fluids draining from the supply lines, which maintains the water level within the discharge box 70 at the same external water level 25. In a preferred embodiment, a second discharge box 70', forming a mirror image of the first discharge box 70, provides redundancy with the ability to perform maintenance on one discharge box 70 while the other discharge box is in service. The discharge box 70 relies upon head pressure, and thereby eliminates the need for a discharge pump or multiple discharge outlets.

Figure 11:
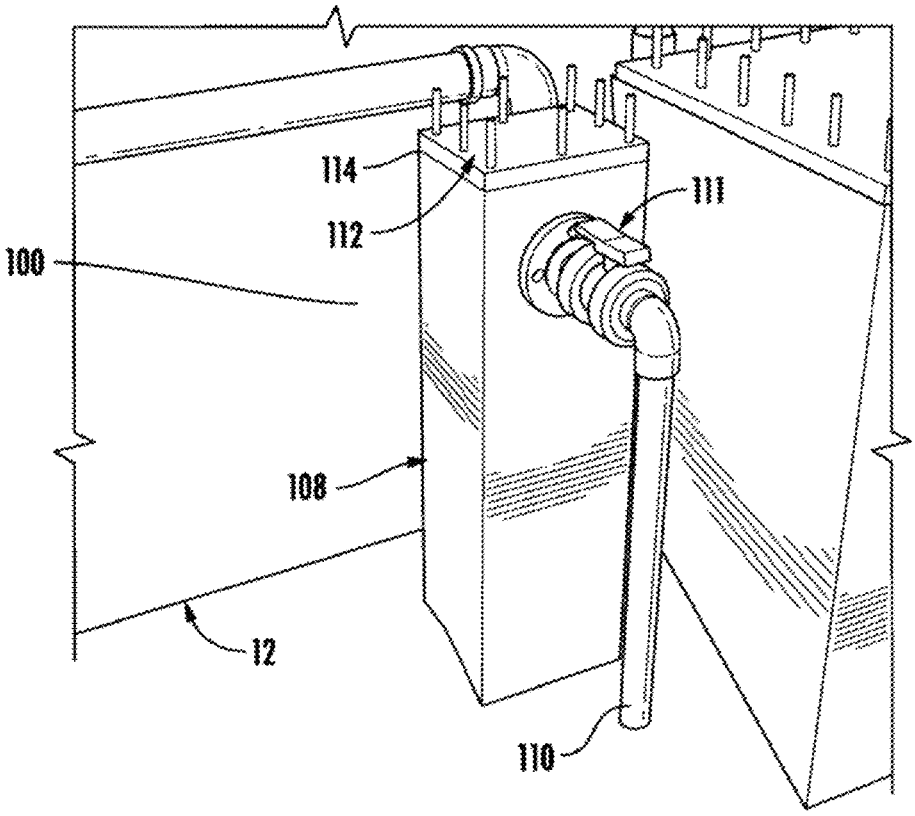
FIG. 11 is a perspective view of a black water discharge box.
Figure 12:
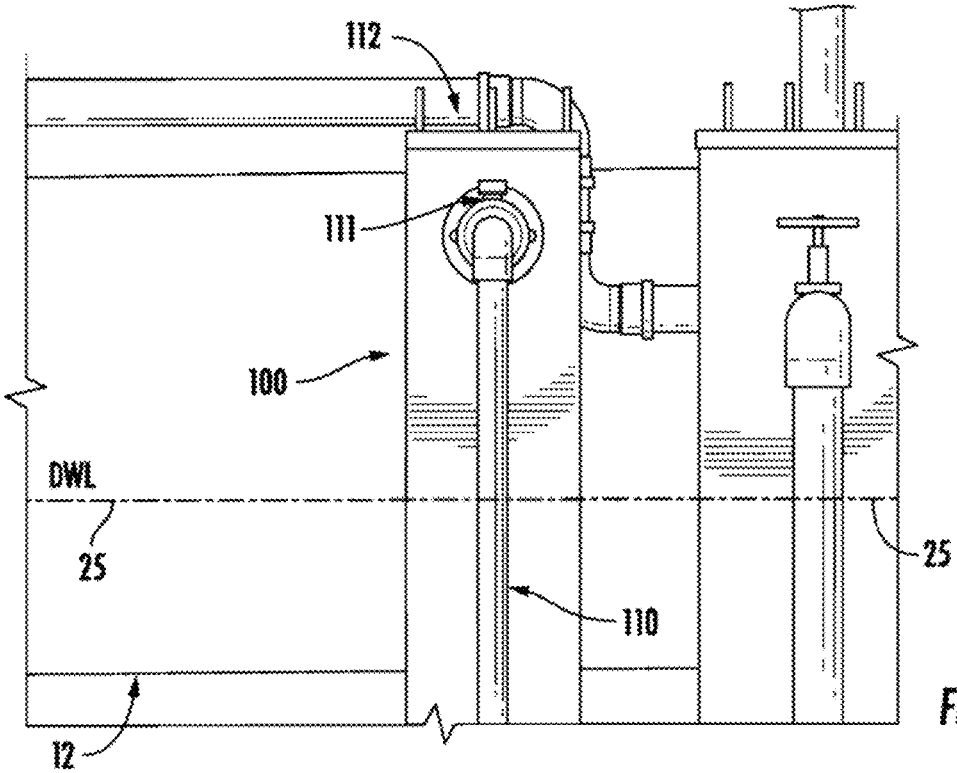
FIG. 12 is a side view of the black water discharge box.
Figure 13:
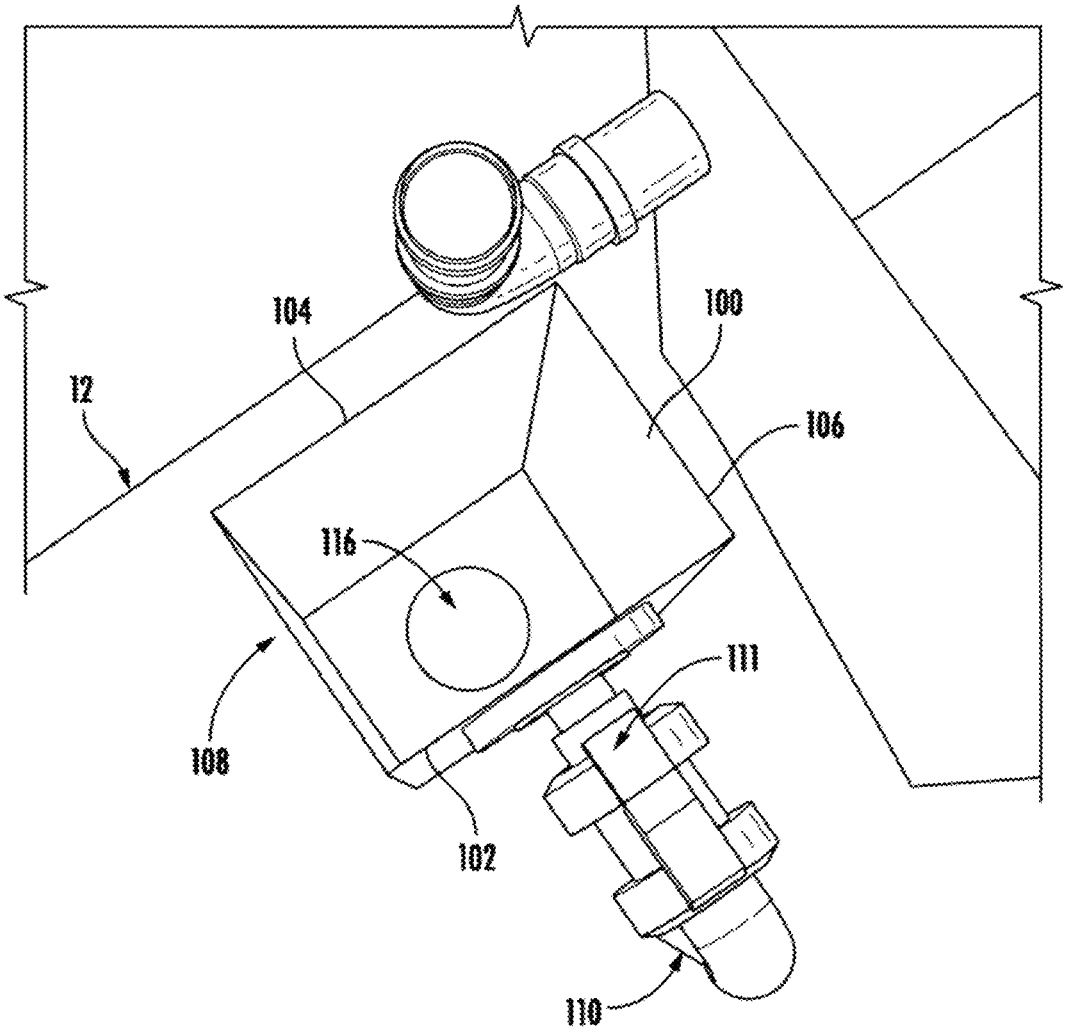
FIG. 13 is a top view of the interior components of the black water discharge box.

Referring to FIGS. 11-13, disclosed is a black water discharge box 100 comprising a front wall 102 spaced apart from a rear wall 104 by opposing side walls 106, 108. The walls are preferably composed of the same structural material as the vessel hull 12. In the preferred embodiment, the discharge box 100 is formed integral with the vessel hull 12. In this embodiment, the discharge of treated waste from a Type II marine biological aerobic sanitation device is directed through outlet pipe 110, having a shut off valve 111 before insertion into the discharge box 100 at a point above the vessel water line 25. The discharge box 100 having a watertight hatch 112 securable to the upper edge 114 of the box 100. The bottom of the discharge box 100 having a threaded outlet thru-hull 116 that leads through the vessel hull 12 and opens through the bottom of the vessel. A stand pipe, as shown in FIG. 5, is available for placement in the threaded outlet 116 to raise the outlet above the vessel water line 25 to prohibit egress during maintenance. For ease of drawing clarity, the stand pipe is only depicted in FIG. 5 as element 65. In the preferred embodiment, the stand pipe 65 can be used on the discharge box 70, the black water discharge box 100 or the sea chest 10.

The term "coupled" is defined as connected, although not necessarily directly, and not necessarily mechanically. The use of the word "a" or "an" when used in conjunction with the term "comprising" in the claims and/or the specification may mean "one," but it is also consistent with the meaning of "one or more" or "at least one." The use of the term "or" in the claims is used to mean "and/or" unless explicitly indicated to refer to alternatives only or the alternative are mutually exclusive, although the disclosure supports a definition that refers to only alternatives and "and/or."

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements. Likewise, a step of a method or an element of a device that "comprises," "has," "includes" or "contains" one or more features, possesses those one or more features, but is not limited to possessing only those one or more features. Furthermore, a device or structure that is configured in a certain way is configured in at least that way, but may also be configured in ways that are not listed.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A sea chest comprising:

a first end wall spaced apart from a second end wall by opposing side walls, each said end wall and said opposing side wall having a bottom edge formed integral with a vessel hull and a top edge of each said end wall and said opposing side wall positioned above a vessel waterline forming an access opening wherein an inner surface of said end walls and said opposing side walls and an inner surface of said vessel hull form a chamber;

a thru-hull opening having an intake formed in bottom of said chamber, said intake having a proximal end fluidly coupled to an open distal end formed on an outer surface of said vessel hull, wherein said thru-hull opening allowing water to fill said chamber up to said vessel waterline;

a supply inlet formed in one of said end walls or said opposing side walls, said supply inlet fluidly coupled to a supply manifold having a plurality of outlets for supply water from said chamber to vessel machinery;

a standpipe releasably secured to said proximal end of said intake, said standpipe having a length extending from said proximal end to a position above said vessel waterline; and a watertight hatch releasably secured to said access opening;

wherein said chamber provides an inlet for water drawn into said supply manifold, whereby securing said standpipe to said proximal end prohibits flow of water from entering said supply inlet.

2. The sea chest according to claim 1 including an ultra violet light mounted within said chamber, said ultraviolet light sealed from the water by a transparent shield.

3. The sea chest according to claim 1 wherein said end walls and said opposing side walls are constructed of a same structural material as said vessel hull.

4. The sea chest according to claim 1 wherein said end walls and said opposing side walls are formed integral with said vessel hull.

5. The sea chest according to claim 1 wherein said proximal end is threaded and said standpipe is constructed and arranged to secure to said proximal end having reciprocal threads.

6. The sea chest according to claim 1 wherein said supply manifold includes a manual control valve coupled to each said supply manifold.

7. The sea chest according to claim 1 wherein said supply manifold includes at least one inlet available for coupling to an external source of water.

8. The sea chest according to claim 1 including a second sea chest forming a mirror image of said first sea chest, in which the first sea chest and second sea chest are fluidly coupled to each other through said supply manifold.

* * * * *